US006227105B1

(12) United States Patent
Kayser

(10) Patent No.: US 6,227,105 B1
(45) Date of Patent: May 8, 2001

(54) CALENDER FOR A WEB, IN PARTICULAR A PAPER WEB, PROCESS FOR FORMING THE CALENDER, AND PROCESS FOR TREATING THE WEB WITH THE CALENDER

(75) Inventor: Franz Kayser, Geldern (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/215,138

(22) Filed: Dec. 18, 1998

(30) Foreign Application Priority Data

Dec. 23, 1997 (DE) ..... 197 57 472

(51) Int. Cl.[7] ..... B30B 3/04

(52) U.S. Cl. ..... 100/161; 100/76; 100/162 B; 100/163 A; 100/172

(58) Field of Search ..... 100/160, 161, 100/162 R, 162 B, 163 A, 163 R, 155 R, 172, 76, 331

(56) References Cited

U.S. PATENT DOCUMENTS

| | | | | |
|---|---|---|---|---|
| 4,471,690 | | 9/1984 | Yamaguchi et al. . | |
| 4,519,757 | | 5/1985 | Wittkopf et al. . | |
| 4,736,678 | * | 4/1988 | Stotz | 100/163 A |
| 5,784,955 | * | 7/1998 | Conrad | 100/172 |

FOREIGN PATENT DOCUMENTS

| | | | | |
|---|---|---|---|---|
| 682688 | | 10/1939 | (DE) . | |
| 2603484 | | 8/1977 | (DE) . | |
| 2603485 | | 8/1977 | (DE) . | |
| 2752034 | | 5/1979 | (DE) . | |
| 19511145 | | 10/1996 | (DE) . | |
| 202753 | * | 8/1923 | (GB) | 100/162 R |
| 95/14813 | | 6/1995 | (WO) . | |

OTHER PUBLICATIONS

Ulrich Rothfuss, Das Janus Concept –die alternative Satinagetechnologie für gestrichene Papiere, Vorgetragen auf dem Kufferath–Symposium vom 2.–22. Sept. 1995 in Dermbach, with an English language copy.

* cited by examiner

*Primary Examiner*—Peter Vo
*Assistant Examiner*—Louis Huynh
(74) *Attorney, Agent, or Firm*—Greenblum & Bernstein, P.L.C.

(57) ABSTRACT

Calender for a web, process of forming the calender, and process of treating a web in the calender. The calender includes rolls having rotational axes and a roll stack composed of the rolls. The rolls of the roll stack are arranged such that the rotational axes are positionable in a horizontal plane. The calender also includes levers. The rolls include end rolls and middle rolls, the middle rolls being coupled to the levers. The calender also includes force devices positioned to exert a force on the levers. The process of forming includes arranging the rotational axes of the rolls in a horizontal plane, coupling levers to the middle rolls arranged between the end rolls of the roll stack, and coupling force devices to the levers. The process of treating the web includes guiding the web through the roll stack, pressing an end roll of the roll stack in a horizontal direction toward the other end roll of the roll stack, and adjusting a line load between adjacent rolls of the roll stack.

11 Claims, 2 Drawing Sheets

CALENDER FOR A WEB, IN PARTICULAR A PAPER WEB, PROCESS FOR FORMING THE CALENDER, AND PROCESS FOR TREATING THE WEB WITH THE CALENDER

CROSS-REFERENCE TO RELATED APPLICATIONS

The present application claims priority under 35 U.S.C. §119 of German Patent Application No. 197 57 472.6, filed on Dec. 23, 1997, the disclosure of which is expressly incorporated by reference herein in its entirety.

BACKGROUND OF THE INVENTION

1. Field of the Invention

The present invention is related to a calender for a web, e.g., a paper web. The calender includes a stack of rolls having axes that are located in a horizontal plane.

2. Discussion of Background Information

Conventional type calenders, which include a stack of rolls having horizontal axes that are located one above the other in a vertical plane, are used for treating paper, paperboard, plastic foils, and similar material. The nips are either formed by adjacent hard rolls or, particularly in paper refining, are formed by an adjacent hard roll and soft roll. The line load in the nips is provided by hydraulic force transmitters that engage an end roll of the roll stack and by the weight of the rolls. Thus, the line load, and, therefore, the compressive strain, increases from the top to the bottom of the roll stack. In this regard, the variation range of the forces that can be exerted by the force transmitters is relatively small. Further, a limitation of force toward the top of the roll stack must be produced to avoid too intensely stressing the web material in the bottom nip, and to ensure that the web material experiences no further deformation in the top nip.

A calender similar in general to the above described calender is disclosed in WO 95/14813, in which the end rolls are formed with deflection adjustment rolls and the middle rolls are supported on levers engaged by devices for exerting a force. The rolls are designed so that natural deflection lines produced by the weight of the rolls is essentially the same. Further, the nip load generated by the masses of the middle rolls and the associated auxiliary devices is essentially completely canceled out by the devices for exerting force. Theoretically, the entire influence of gravity can be eliminated in this manner, however, in practical terms, extreme difficulties are caused in fulfilling the above-mentioned conditions. In particular, if not all rolls have a same deflection due to their weight, then during operation, higher pressure loads occur on either the edges or in the middle of the roll.

Another calender similar to the above-described calender is disclosed in DE 26 03 484 A1 or DE 26 03 485 A1, substantially avoids the above-noted problems associated with the roll weight. In this calender, the horizontal axes of the rolls are located next to one another so that the weight influence of the rolls on the line load is completely eliminated. The rolls are secured in bearing blocks that can be slid along a guide. One end roll is fixed in place and the other end roll is loaded in the direction of the one end roll by force transmitters in the form of piston/cylinder units. With this calender, the same line load prevails in all of the nips.

SUMMARY OF THE INVENTION

The present invention provides a calender of the type generally discussed above which can be operated with different line loads in the individual nips.

The present invention provides end rolls composed of deflection adjustment rolls and middle rolls supported on levers engaged by devices for exerting force.

With the arrangement of the calender in accordance with the features of the present invention, the desired line load may be adjustable in each nip by levers that are loaded by the devices for exerting force. In the present invention, the levers and devices for exerting force are utilized even though they are not necessary for their conventionally known purpose of weight relief. The deflection adjustment rolls on the ends of the roll stack may support the adjustment of the line load and, in particular, permit an evening out of the line load in the direction of the web width.

It may be particularly advantageous to generate a fundamental line load that is substantially the same in all nips, to load the one end roll, e.g., by force transmitters, in a direction of the other end roll. Since roll weight has no effect on the line load in this arrangement, the fundamental line load that is exerted by the force transmitters can be freely selected within a large range. In particular, a relatively large line load can be provided at the first nip. Since the devices for exerting force only have to exert auxiliary forces, they can be embodied as comparatively small.

The devices for exerting force may be, preferably, operational in two directions. In a first direction, the line load may be generated or increased; and in a second direction, the line load may be reduced, if necessary, to rapidly separate the rolls.

It may also be advantageous to provide separate drives for the rolls, which substantially prevents lateral deflections of the rolls. Lateral deflections may occur when a single driven roll causes the other rolls to move via friction.

In a preferable embodiment, a frame supporting the rolls may be moved from an operating position, in which the roll axes are located in a horizontal plane, into a rest position, in which the roll axes are located in a vertical plane, i.e., one above the other. In the rest position, the material web may be introduced into the nip of the calender in the conventional manner. For operation, the calender may be pivoted into the operating position.

In an exemplary embodiment, a horizontal pivot axis may be provided, around which, the frame can be pivoted by approximately 90°.

It may be preferable to couple at least one winding station to the frame through a common support. In this manner, the winding station and the calender may be jointly pivoted.

In an alternative embodiment of the present invention, at least one fixed winding station may includes a roll with a horizontal axis and at least one guide roll with a horizontal axis. The at least one guide roll may be arranged between the winding station and the roll stack. The at least one guide roll may be contacted by the web only when the frame is moved out of the rest position and into the operating position. In this instance, it may only be necessary to pivot the calender.

Accordingly, the present invention is directed to a calender for a web that includes rolls having rotational axes and a roll stack composed of the rolls. The rolls of the roll stack are arranged such that the rotational axes are positionable in a horizontal plane. The calender also includes levers. The rolls include end rolls and middle rolls, and the middle rolls are coupled to the levers. The calender also includes force devices positioned to exert a force on the levers.

In accordance with another feature of the present invention, force transmitters may be provided to load one of the end rolls in a direction of the other of the end rolls. In this manner, a uniform fundamental line load may be exerted in all of the nips.

In accordance with another feature of the present invention, the force devices may be operable for exerting force in two directions.

In accordance with still another feature of the present invention, separate drives associated with each of the rolls may be provided. In this manner, lateral deflections of the rolls are substantially prevented.

In accordance with a further feature of the present invention, a frame that supports the rolls may be provided. The frame may be movable from an operating position, in which the roll axes are located in the horizontal plane, into a rest position, in which the roll axes are located in a vertical plane. Further, the frame may include a horizontal pivot axis and the frame may be pivotable around the horizontal pivot axis through an angle of approximately 90°.

In accordance with a still further feature of the present invention, at least one winding station and a frame that supports the rolls may be included. The at least one winding station may be coupled to the frame.

In accordance with another feature of the present invention, at least one fixed winding station may be provided having a roll with a horizontal axis. At least one guide roll with a horizontal axis may be arranged between the at least one fixed winding station and the roll stack. In this manner, the at least one guide roll may be contacted by the web when the frame is in the operating position. Further, the at least one guide roll may not be contacted by the web when the frame is in the rest position.

In accordance with still another feature of the present invention, the web may include a paper web.

In accordance with a further feature of the present invention, the end rolls may be composed of deflection adjustment rolls.

The present invention may be directed to a process for forming a calender having roll with rotational axes and a roll stack composed of the rolls. The process includes arranging the rotational axes of the rolls in a horizontal plane, coupling levers to the middle rolls arranged between the end rolls of the roll stack, and coupling force devices to the levers.

In accordance with another feature of the present invention, the process may further include loading one of the end rolls of the roll stack in a direction of the other of the end rolls.

In accordance with a further feature of the present invention, the process may further include adjustably moving the levers with the force devices in one of two directions.

In accordance with a still further feature of the present invention, the process may further include separately driving each of the rolls.

In accordance with still another feature of the present invention, may further include supporting the rolls on a frame. The frame may be movable from an operating position, in which the roll axes are located in the horizontal plane, into a rest position, in which the roll axes are located in a vertical plane. Further, the process may include forming a horizontal pivot axis in the frame, such that the frame may be pivotable around the horizontal pivot axis through an angle of approximately 90°.

In accordance with still another feature of the present invention, the process may further include coupling at least one winding station and the rolls on a frame.

In accordance with another feature of the present invention, the process may further include positioning at least one guide roll between at least one fixed winding station, which is coupled to the roll stack via the web, and the roll stack. The at least one guide roll may be contacted by the web when the calender is in an operating position. Further, the at least one guide roll may not be contacted by the web when the frame is in the rest position, in which the rotational axes of rolls of the roll stack are arranged in a vertical plane.

In accordance with a still further feature of the present invention, the process further includes forming the end rolls with deflection compensation rolls.

The present invention may also be directed to a process for treating a web in a calender including rolls having rotational axes and a roll stack composed of the rolls. The process includes guiding the web through the roll stack, pressing an end roll of the roll stack in a horizontal direction toward the other end roll of the roll stack, and adjusting a line load between adjacent rolls of the roll stack.

In accordance with still another feature of the present invention, the guiding of the web may include arranging the roll stack in a vertical direction and threading the web through the roll stack, and the process may further include pivotably moving the roll stack approximately 90° to arrange the roll stack in a horizontal direction.

In accordance with another feature of the present invention, the process may further include pivotably moving the roll stack relative to at least one winding device.

In accordance with yet another feature of the present invention, the process may further include pivotably moving the roll stack and at least one winding device.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
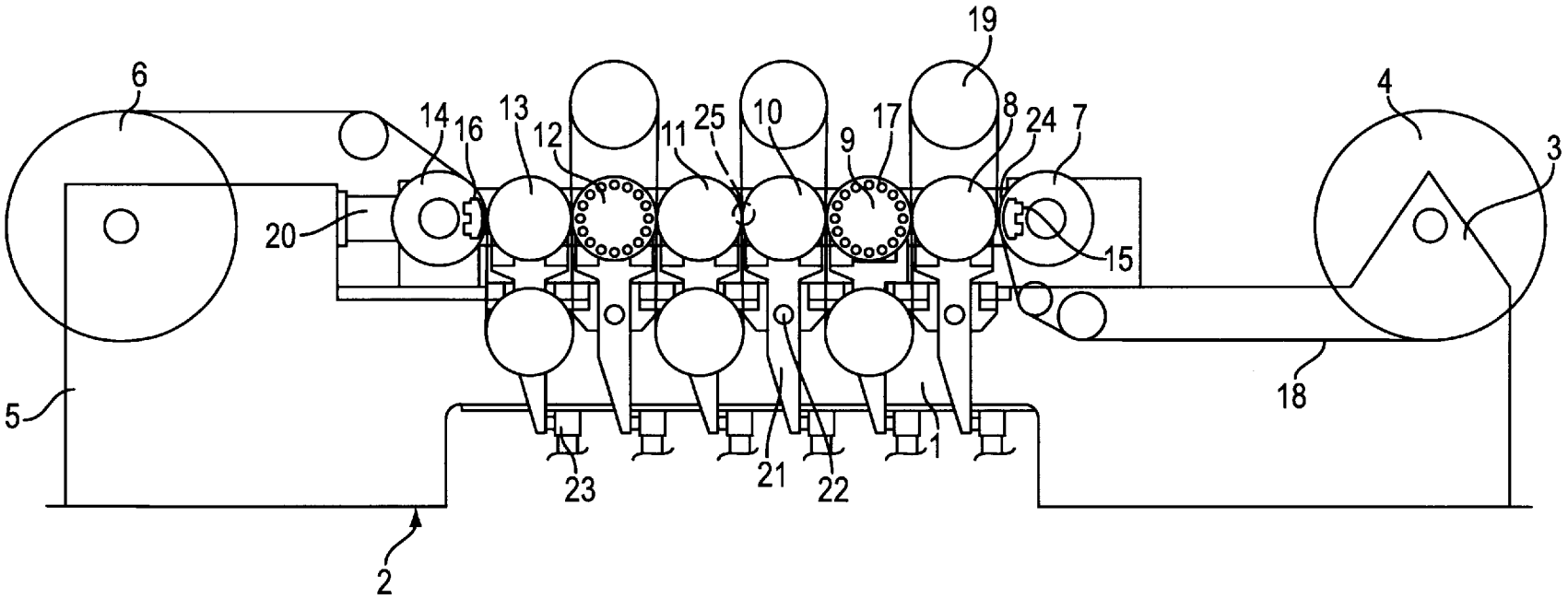
FIG. 1 schematically illustrates a front view of a calender in an operating position accordance with the present invention.

A calender, as schematically illustrated in FIG. 1, includes a frame 1, which is part of a support 2. Frame 1 carries at least one winding station, e.g., an unwinding station 3 for a roll 4 and a winding station 5 for a roll 6. The calender may include a roll stack of, e.g., eight rolls 7, 8, 9, 10, 11, 12, 13, and 14, which are located next to one another such that their axes are located in a same horizontal plane. The end rolls 7 and 14 of the roll stack may be composed of deflection adjustment rolls, as is schematically represented in FIG. 1 by support elements 15 and 16, which may be hydraulically actuatable support elements. The middle rolls 8–13 may include, e.g., two heatable rolls 9 and 12 composed of cast iron and including peripherally arranged heating medium conduits 17 and four rolls 8, 10, 11, and 13 having an elastic cover. A web 18, e.g, a paper web, may be guided to pass through the nips formed by the rolls of the roll stack by a plurality of guide rolls 19.

End roll 7 may be supported, e.g., fixedly supported for rotation, on frame 1. End roll 14 may be loaded in a direction of end roll 7 by force transmitters 20, e.g., composed of piston/cylinder units. In this manner, a fundamental line load in the nips between individual rolls 7–14 may be produced.

Middle rolls 8–13 may be supported by levers 21, which may be pivotable around horizontal axes 22. Levers 21 may be loaded by devices 23, e.g., composed of piston/cylinder units, which may be operational in two directions. Further, each of rolls 7–14 may be provided with a separate drive (not shown).

In accordance with the exemplary illustration, a fundamental line load may be produced in nip 24, i.e., formed between rolls 7 and 8, by force transmitters 20 loading rolls 7–14, e.g., pressing roll 14 in the direction of roll 7. The line load in nip 24 may be increased via device 23 by exerting a force on lever 21 in a first direction to additionally press roll 8 against roll 7; and the line load in nip 24 may be decreased via device 23 by exerting a force on lever 21 in a second direction, i.e., opposite the first direction, to reduce the pressing force of roll 8 against roll 7. The force exerted by device 23 in the second direction may be also be utilized to separate the rolls if end roll 14 has been removed or displaced from the remaining rolls, e.g., moved in a leftwardly direction in the exemplary illustration so that no force is exerted on rolls 7–13. In other words, after the fundamental line load has been removed.

Support 2 may include a horizontal pivot axis 25, and support 2 may be arranged to be pivotable, approximately 90°, around horizontal pivot axis 25. In this manner, support 2, including frame 1 and winding stations 3 and 5, may be placed in a rest position approximately 90° from the operational position depicted in the exemplary illustration. In the rest position, web 18 may be introduced into the calender in the conventional manner, e.g., the top of the roll stack toward the bottom of the roll stack.

Figure 2:
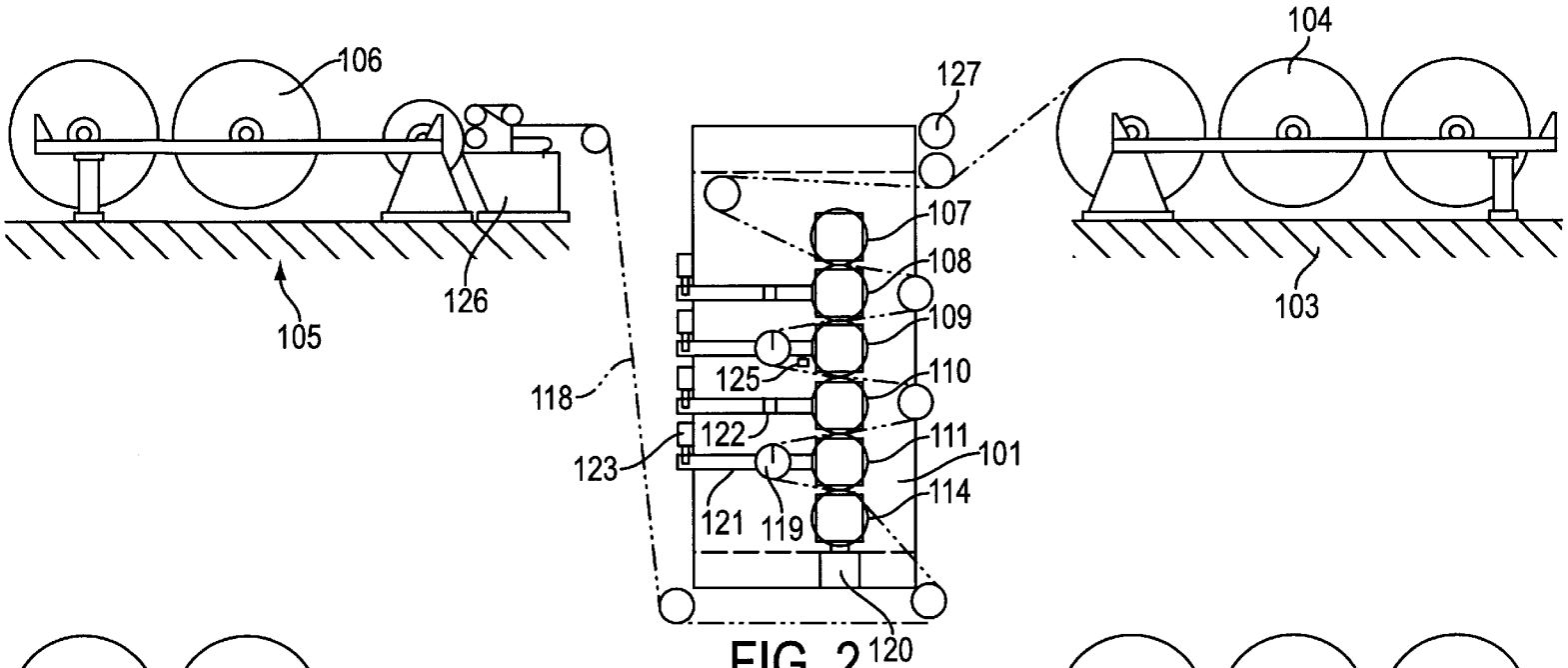
FIG. 2 illustrates an alternative embodiment of a calender in a rest position in accordance with the present invention.
Figure 3:
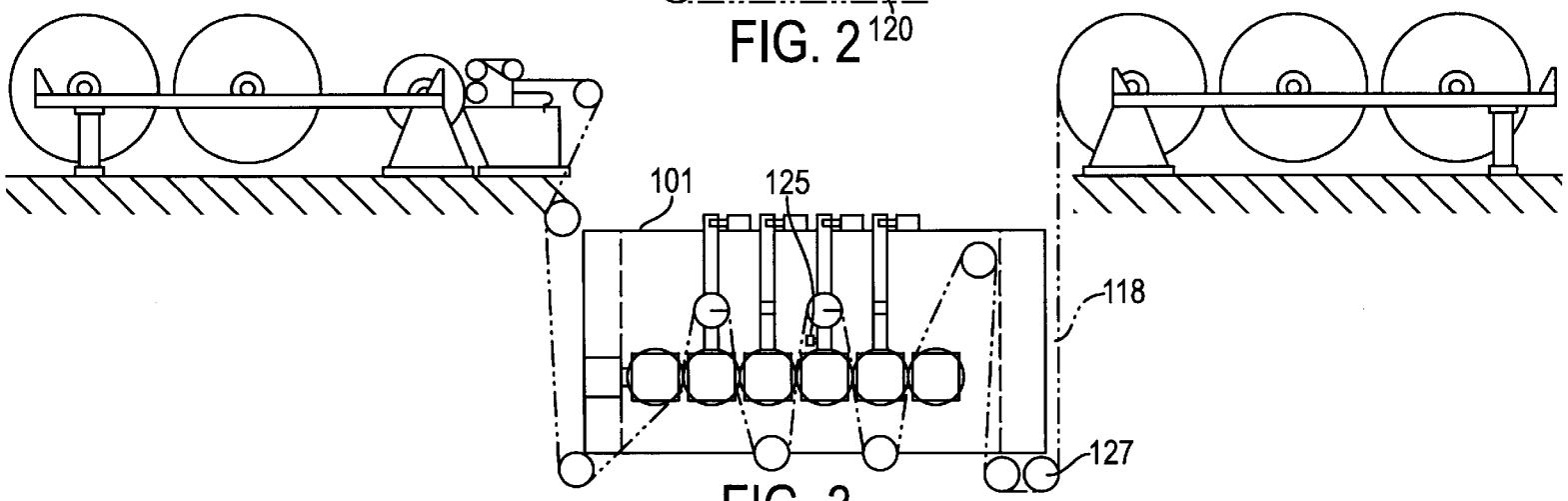
FIG. 3 illustrates the calender depicted in FIG. 2 in the operating position.

In the exemplary embodiment depicted in FIGS. 2 and 3, reference numerals identifying elements corresponding to those discussed above in FIG. 1 have been increased by 100. In the exemplary illustrations of FIGS. 2 and 3, unwinding station 103 and winding station 105 may be fixedly coupled to frame 101 and the calender may be pivotable around a pivot axis 125 by an angle of approximately 90°. Winding station 105 may also include a reel cutter 126. The roll stack may include two end rolls 107 and 114, which may be composed of deflection adjustment rolls, and four middle rolls 108–111, which may be supported on pivotable levers 121. Levers 121 may be pivoted around horizontal pivot axes 122 and may be loaded by devices 123 for exerting force.

In this exemplary embodiment, web 118 may be guided through the calender by a plurality of guide rolls 119. In particular, reference is made to a guide roll 127, which is only active when the calender frame 101 is pivoted from the rest position of FIG. 2 into the operating position of FIG. 3.

The arrangement of the rolls and their equipment can also be selected differently than that represented in the exemplary embodiments without departing from the spirit of the present invention. Further, the number of calender rolls utilized in the roll stack may vary, e.g., from two to twelve rolls.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A calender for a web comprising:

rolls having rotational axes;

a roll stack composed of the rolls, and the rolls of the roll stack being arranged such that the rotational axes are positionable for operation in a common horizontal plane;

levers;

the rolls comprising end rolls and middle rolls, the middle rolls being coupled to the levers;

force devices positioned to exert a force on the levers; and the force devices being operable for exerting force in two directions.

2. The calender according to claim 1, further comprising force transmitters adapted to load one of the end rolls in a direction of the other of the end rolls, whereby nips are formed between adjacent rolls and a uniform fundamental line load is exerted in all of the nips.

3. The calender according to claim 1, further comprising separate drives associated with each of the rolls, whereby lateral deflections of the rolls are substantially prevented.

4. The calender according to claim 1, wherein the web comprising a paper web.

5. The calender according to claim 1, wherein the end rolls being composed of deflection compensation rolls.

6. A calender for a web comprising:

rolls having rotational axes;

a roll stack composed of the rolls, and the rolls of the roll stack being arranged such that the rotational axes are positionable in a horizontal plane;

levers;

the rolls comprising end rolls and middle rolls, the middle rolls being coupled to the levers;

force devices positioned to exert a force on the levers; and a frame that supports the rolls;

the frame being movable from an operating position, in which the roll axes are located in the horizontal plane, into a rest position, in which the roll axes are located in a vertical plane.

7. The calender according to claim 5, wherein the frame comprising a horizontal pivot axis; and the frame being pivotable around the horizontal pivot axis through an angle of approximately 90°.

8. The calender according to claim 6, further comprising:

at least one winding station; and the at least one winding station being coupled to the frame.

9. A calender for a web comprising:

rolls having rotational axes;

a roll stack composed of the rolls, and the rolls of the roll stack being arranged such that the rotational axes are positionable in a common horizontal plane;

levers;

the rolls comprising end rolls and middle rolls, the middle rolls being coupled to the levers;

force devices positioned to exert a force on the levers;

at least one fixed winding station having a roll with a horizontal axis;

at least one guide roll with a horizontal axis arranged between the at least one fixed winding station and the roll stack; and a frame that supports the rolls;

wherein the at least one guide roll is contacted by the web when the frame is in an operating position, in which the roll axes are located in the common horizontal plane.

10. The calender according to claim 8, wherein the at least one guide roll is not contacted by the web when the frame is in a rest position, in which the roll axes are located in a common vertical plane.

11. A calender for a web comprising:

rolls having rotational axes;

a roll stack composed of the rolls, and the rolls of the roll stack being arranged such that the rotational axes are positionable for operation in a common horizontal plane;

levers;

the rolls comprising end rolls and middle rolls, all of the middle rolls being coupled to the levers;

force devices positioned to exert a force on the levers; and deflection adjustment rolls adapted to load one of the end rolls in a direction of the other of the end rolls, whereby nips are formed between adjacent rolls and a uniform fundamental line load is exerted in all of the nips.

* * * * *